US012071779B2

(12) United States Patent
Owens

(10) Patent No.: US 12,071,779 B2
(45) Date of Patent: Aug. 27, 2024

(54) SHORING SUPPORT STRUCTURE

(71) Applicant: Grove Design (Pembridge) Limited, Leominster (GB)

(72) Inventor: Austin Owens, Leominster (GB)

(73) Assignee: GROVE DESIGN (PEMBRIDGE) LTD., Pembridge Leominster (GB)

( * ) Notice: Subject to any disclaimer, the term of this patent is extended or adjusted under 35 U.S.C. 154(b) by 181 days.

(21) Appl. No.: 17/632,274

(22) PCT Filed: Jul. 31, 2020

(86) PCT No.: PCT/EP2020/071708
§ 371 (c)(1),
(2) Date: Feb. 2, 2022

(87) PCT Pub. No.: WO2021/023669
PCT Pub. Date: Feb. 11, 2021

(65) Prior Publication Data

US 2022/0275660 A1 Sep. 1, 2022

(30) Foreign Application Priority Data

Aug. 8, 2019 (GB) ..... 1911337

(51) Int. Cl.
*E04G 25/06* (2006.01)

(52) U.S. Cl.
CPC ..... *E04G 25/065* (2013.01); *E04G 25/063* (2013.01)

(58) Field of Classification Search
CPC . B66F 3/16; B66F 3/18; E04G 25/065; E04G 25/063; E04G 2025/006
(Continued)

(56) References Cited

U.S. PATENT DOCUMENTS 5,590,863 A * 1/1997 Sasaki ..... E04G 17/14 248/354.3
6,446,937 B1 * 9/2002 Straw, Sr. ..... B66F 3/16 248/352

(Continued)

FOREIGN PATENT DOCUMENTS

FR 2 400 093 3/1979
GB 2 479 008 9/2011

(Continued)

OTHER PUBLICATIONS

International Search Report {Mailing Date Oct. 22, 2020} and Written Opinion {Mailing Date Oct. 19, 2020} for PCT/EP2020/071708.

(Continued)

*Primary Examiner* — Bradley Duckworth
(74) *Attorney, Agent, or Firm* — Neil D. Gershon

(57) ABSTRACT

A shoring support structure (3) comprising an outer tube (2) having a threaded region (22) with opposing longitudinal slots (16) and an inner tube (4) slidable within the outer tube and having a plurality of pairs of transverse holes (14) at spaced apart intervals. The inner tube and outer tubes terminate in a plate (6) and a pin (10) is receivable through the slots of the outer tube and a pair of transverse holes of the inner tube. A collar (8) is mounted on the threaded region and is rotatable to raise and lower the pin within the slots. The collar includes a driven member (30) such as a bevel gear for mating with a driving member (32) such as a pinion connectable to an actuator (38), actuation of the driving member causing rotation of the driven member to effect rotation of the collar (8) to move the pin.

14 Claims, 12 Drawing Sheets

(58) Field of Classification Search
USPC ..... 248/200.1, 352, 354.3, 354.4; 254/103, 254/100
See application file for complete search history.

(56) References Cited

U.S. PATENT DOCUMENTS

| | | | | |
|---|---|---|---|---|
| 2005/0080365 | A1* | 4/2005 | Wu | 601/103 |
| 2009/0101774 | A1* | 4/2009 | Shih | E04G 25/065 248/200.1 |
| 2010/0212923 | A1* | 8/2010 | Zimmermann | B25B 21/008 173/47 |
| 2013/0020105 | A1* | 1/2013 | Cook | B23B 45/001 173/170 |
| 2013/0087749 | A1* | 4/2013 | Hsieh | B60S 9/08 254/134 |
| 2018/0313436 | A1* | 11/2018 | Nielsen | F16H 25/20 |
| 2021/0269292 | A1* | 9/2021 | Guo | B66F 3/10 |

FOREIGN PATENT DOCUMENTS

| | | |
|---|---|---|
| KR | 100 828 177 | 5/2008 |
| KR | 2014 0147642 | 12/2014 |
| WO | WO 2017/097735 | 6/2017 |

OTHER PUBLICATIONS

UK Search Report for GB 1911337.2 Report Dated Jan. 24, 2020.

* cited by examiner

PRIOR ART

Section A-A

FIG. 7A
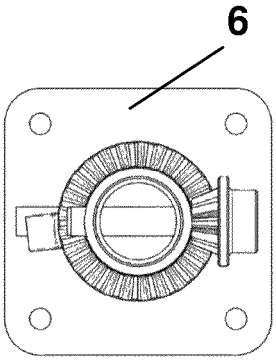
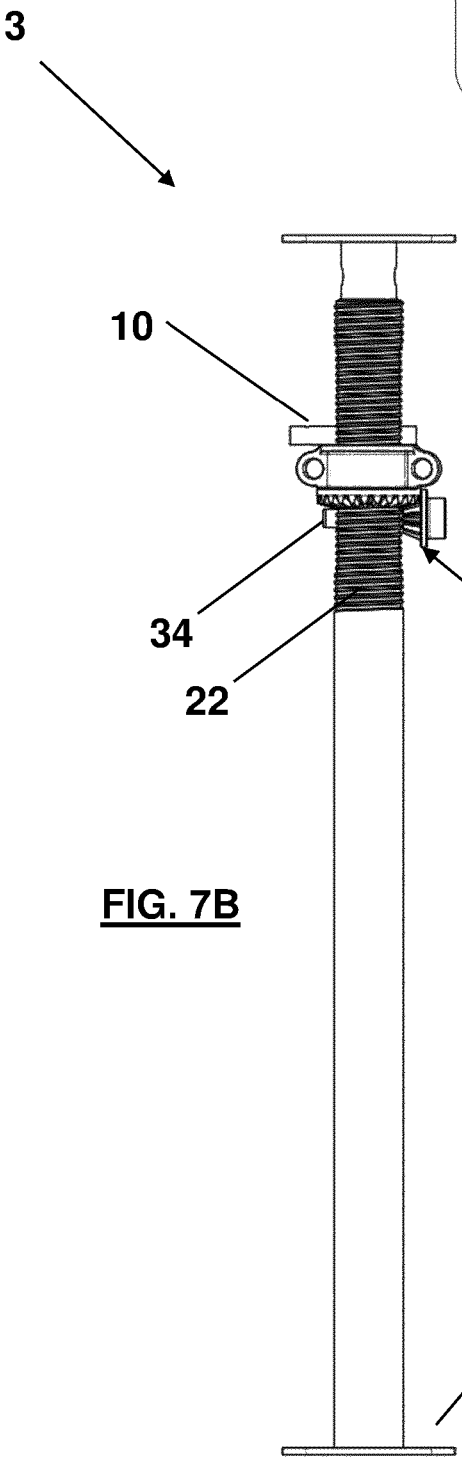
FIG. 7B
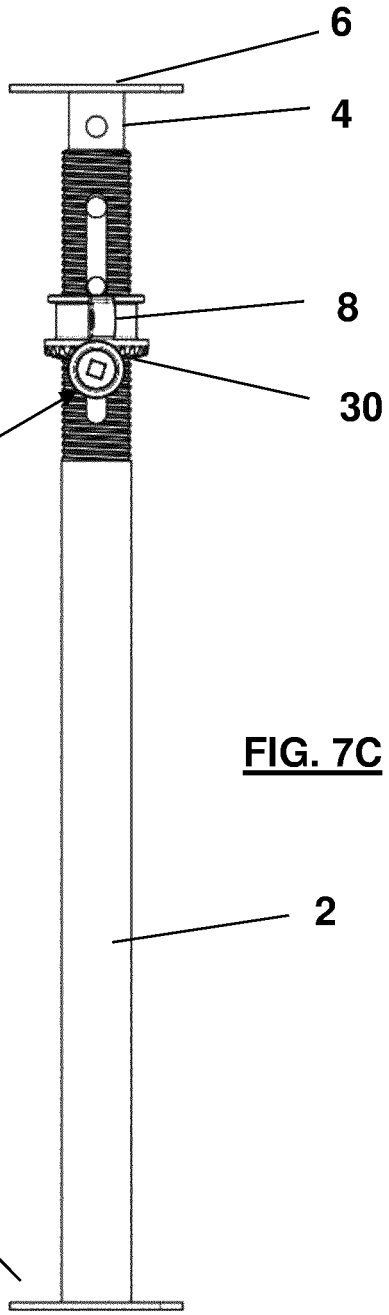
FIG. 7C

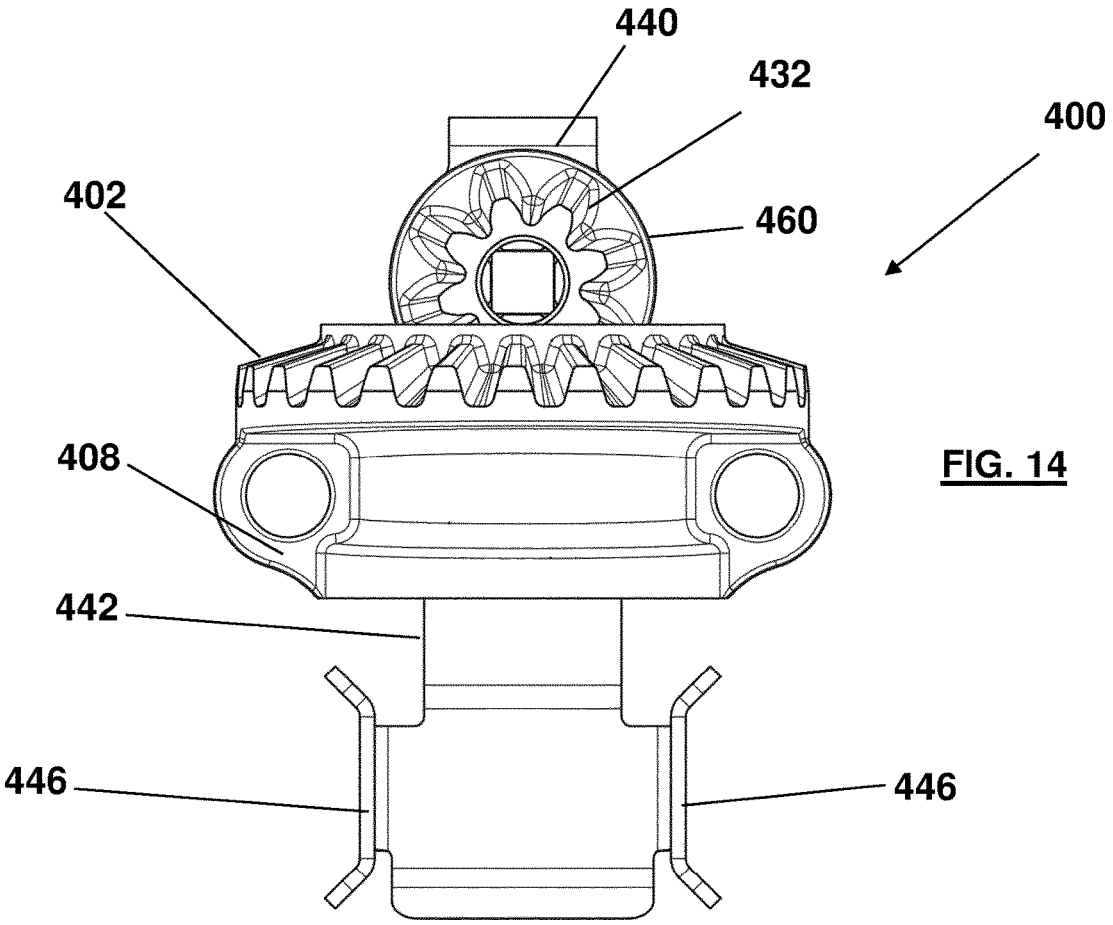
FIG. 14
FIG. 15
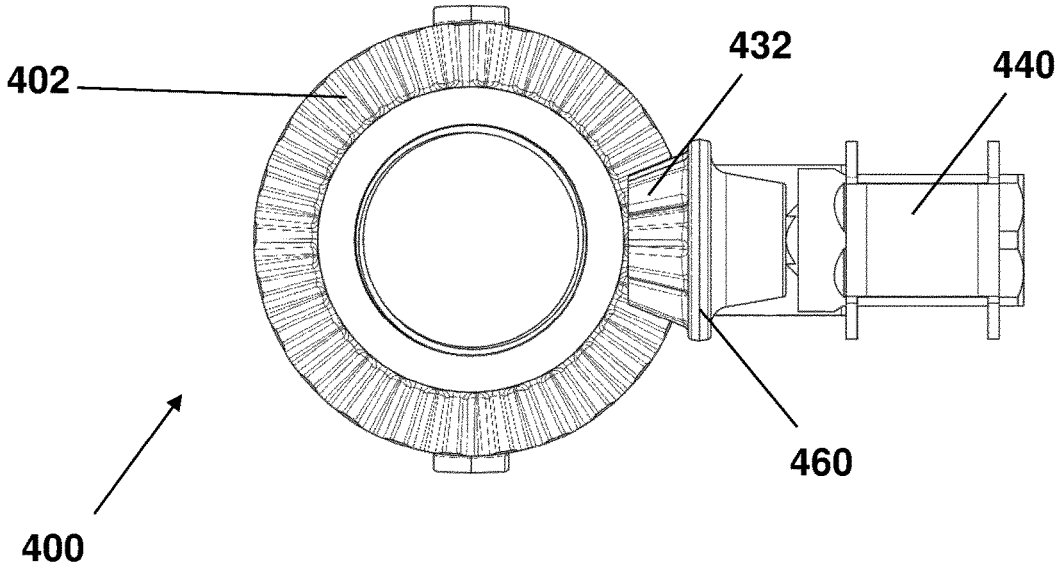

SHORING SUPPORT STRUCTURE

This application is a 371 of PCT/EP2020/071708, filed on Jul. 31, 2020, which claims the benefit of GB 1911337.2, filed on Aug. 8, 2019. The entire contents of each of these applications are hereby incorporated by reference herein.

FIELD OF THE INVENTION

This invention relates to an extendable structure, particularly but not exclusively a shoring support structure for providing a temporary support, commonly referred to as an acrow prop or jack post.

BACKGROUND OF THE INVENTION

It is often essential to be able to support various loads in the building and construction industry to prevent them collapsing while you work in and/or around them, for example during the creation of an archway, window or doorway, during removal of a wall or to temporarily support lintels or floors. Conventionally, a temporary vertical support structure, known as an acrow prop, jack post or shoring post, is inserted into the gap to shore up the load, preventing its collapse while building or repair work is carried out.

As illustrated in FIGS. 1A and 1B of the accompanying drawings, an acrow prop 1 comprises an outer and an inner tube 2, 4, generally of galvanised steel, the inner tube slidable within the outer tube. Each tube has a welded base plate 6 at one end and the outer tube has a threaded region 22 at the other end. A threaded collar 8 with a handle 12 screws onto the outer tube around the central area of the prop, as shown in FIG. 1B. The inner tube has a series of spaced apart holes 14 along its length and a pin is provided for placement within a hole. The outer tube has a longitudinal slot 16. Gross adjustment of the height of the prop is made by removal of the pin, extending the inner tube so that the tubes almost fill the gap, within which supporting will be performed, and then re-inserting the pin in the relevant hole. The pin then sits on the top of the collar and fine adjustment of the prop to the exact height of the gap is achieved by rotating the collar by means of the handle. This extends the inner tube, moving it up slowly until it is adjusted to the correct height. Furthermore, the extending of the prop can apply load.

The acrow prop is provided in different sizes, with each size fitting a different range of gap heights. Different types of plates may be provided at the upper end of the inner tube, such as L-plates and U-plates. The threaded region of the outer tube can be formed onto the tube or may be a section that is friction welded to a plain tube.

Acrow props are extremely hard wearing and are used in vast quantities in the building trade, being adjustable without additional tools or equipment. However, they do suffer from two major drawbacks. Firstly, it can be difficult to install the prop single-handedly due to the need to hold the upper tube in position whilst rotating the threaded collar into position. Secondly, the props are manually installed. This means that they can be difficult and slow to install and remove from a site. This may be particularly problematic on sites where numerous adjacent props need to be installed to support a large area.

It is therefore an aim of the present invention to provide an improved extendable structure, particularly but not exclusively a shoring support structure, which overcomes, or at least alleviates, the above problems.

SUMMARY OF THE INVENTION

According to the present invention there is provided an extendable structure comprising:

- an outer tube having a threaded region with opposing longitudinal slots therethrough;
- an inner tube slidable within the outer tube and having a plurality of pairs of transverse holes at spaced apart intervals;
- a pin receivable through the slots of the outer tube and a pair of transverse holes of the inner tube; and
- a collar mounted on the threaded region and being rotatable to raise and lower the pin within the slots;
- wherein the collar includes a driven member for mating with a driving member connectable to an actuator, actuation of the driving member causing rotation of the driven member to effect rotation of the collar.

In a preferred embodiment of the present invention, the extendable structure comprises a shoring support structure, for example in the form of an acrow prop.

However, it is to be appreciated that the mechanism may be used on any type of extendable structure requiring relative linear movement or loading effected by a driven rotating collar.

Preferably, the driven member is a gear, preferably a bevel gear, which may be provided on an upper or lower surface of the collar. Bevel gears are gears where the axes of two shafts intersect, generally being 90 degrees apart, but can be designed to work at other angles as well.

The driving member is preferably a pinion gear that meshes with the bevel gear provided on the collar. The pinion gear preferably includes a shaft extending therefrom for receipt within a pair of transverse holes in the inner tube.

In one embodiment, the pin serves as the shaft for the pinion gear and the bevel gear is provided on the upper surface of the collar.

In an alternative embodiment, a separate shaft extends from the pinion gear and is provided through additional opposing transverse holes provided in the inner tube. In this embodiment, the bevel gear extends from the lower surface of the collar. The shaft and pinion gear may be removed from the support structure and used to install other such structures.

An outer surface of the pinion gear is preferably provided with a recess or protrusion for mating with a corresponding protrusion or recess of an actuator. The recess and protrusion preferably key together to impart motion from the actuator to rotation of the pinion gear and shaft.

Any suitable actuator may be used but preferably a powered actuator is provided to impart motion to the collar via the driving and driven members. For example, the actuator may comprise an impact driver or electric or battery-operated drill.

Optionally, the pinion gear may include a flange for acting on the collar to prevent axial movement of the gear and shaft. Preferably, the flange comprises an annular flange.

A non-rotatable sleeve may also be included around the shaft or pin to reduce wear.

The gears may be provided with any suitable tooth-bearing faces. The teeth of the respective gears may be initially sized so that they only partially contact each other but become driven in further over time as gear wear occurs. The holes through the inner tube may also be shaped such as to maintain contact between the gears.

Additionally, the pinion gear may be connected to a torque multiplier, for example comprising a gearbox such as a planetary gear Preferably, the torque multiplier is provided with a stabilisation assembly. Preferably, the stabilisation assembly comprises a bracket attached to the torque multiplier, a pair of parallel plates for placement against each side of the inner or outer tube, the plates being connected to the bracket by at least one supporting arm. The stabilisation assembly may be made from a profiled and folded steel plate.

Preferably, at least one of the inner and outer tube terminates in a base plate. However, it is to be appreciated that other types of end members may be provided at one or both ends of the tubes depending upon end use of the structure.

The present invention also provides a kit of parts for adapting an existing extendable structure, particularly but not exclusively a shoring support structure, the kit comprising a collar with a bevel gear on an upper or lower surface thereof and a pinion. The kit may also include at least one of a shaft, a sleeve and an actuator. The kit may also include a torque multiplier, preferably provided with a stabilisation assembly as herein described.

BRIEF DESCRIPTION OF THE DRAWINGS

For a better understanding of the present invention and to show more clearly how it may be carried into effect reference will now be made, by way of example, to the accompanying drawings in which:

FIGS. 7A, 7B and 7C are respectively illustrate a sectional transverse view, front view and side view of the complete shoring support structure shown in FIG. 2;

FIG. 14 is a front view of the kit of parts shown in FIG. 12; and

FIG. 15 is a top view of the kit of parts shown in FIG. 12.

DETAILED DESCRIPTION OF THE INVENTION

The present invention provides a mechanism that may be used on any type of extendable structure requiring relative linear movement or loading effected by a driven rotating collar.

In the illustrated examples, the extendable structure is a shoring support structure for use during building work that may be more quickly and easily installed and removed by the user than support structures according to the prior art. The shoring support structure may be used in the conventional manner of a standard acrow prop or may be powered by a drill or impact driver, equipment that is normally readily available where building work is being undertaken.

Figure 1A:
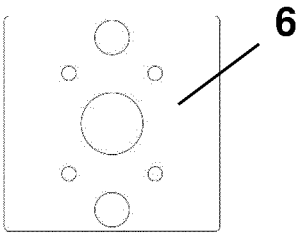
FIGS. 1A and 1B are a top plan view and a side view respectively of a conventional acrow prop according to the prior art.
Figure 1B:
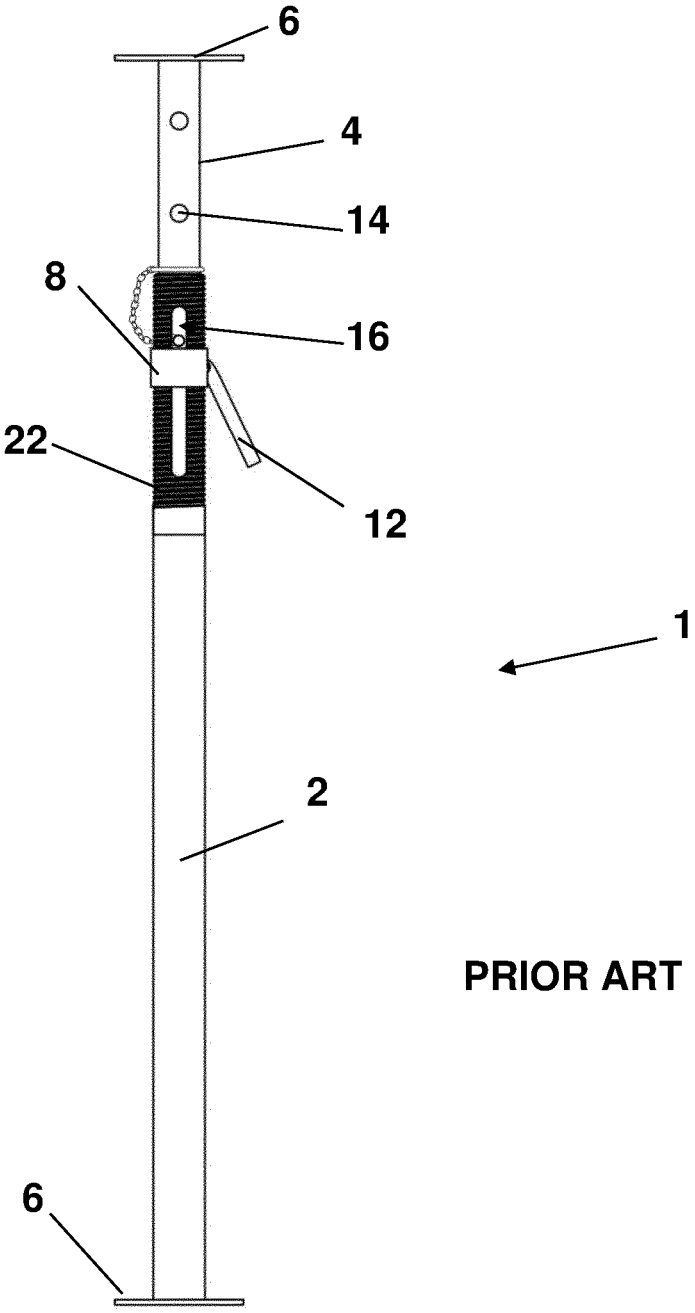
Figure 2:
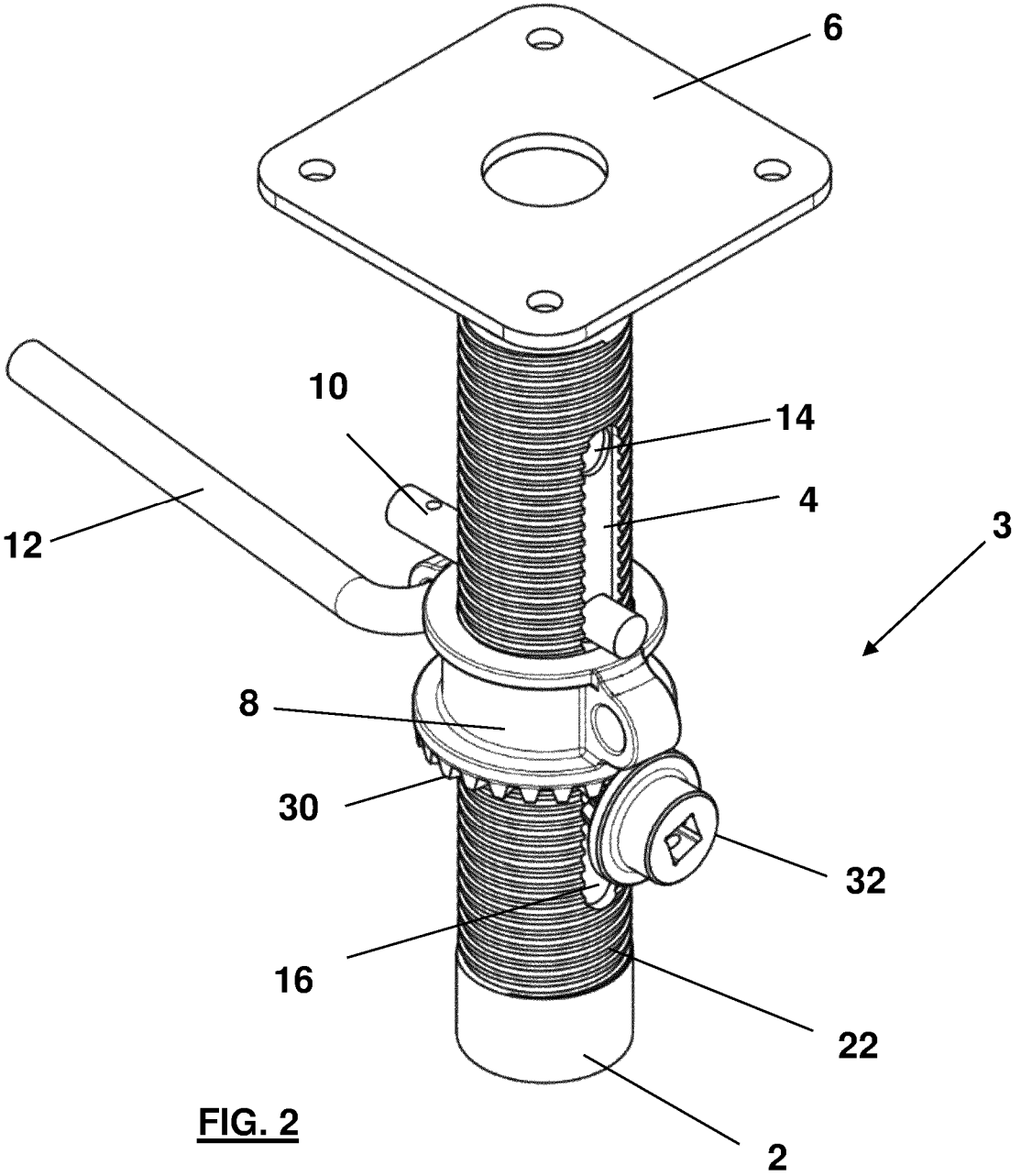
FIG. 2 is a perspective view of an upper part of a shoring support structure according to an embodiment of the present invention.

Referring to FIGS. 2 to 7C of the accompanying drawings, one embodiment of a shoring support structure 3 according to the present invention is illustrated. The structure has a pair of telescopically extendable cylindrical tubes of galvanised steel, comprising an inner tube 4 and an outer tube 2. The free end of the inner tube is provided with a head plate 6 and the free end of the outer tube is provided with a base plate 6. The inner tube 4 is provided with a series of spaced apart pairs of opposing transverse holes 14 and the outer tube is provided with a threaded region 22 in an upper region of the tube which includes two opposing longitudinal slots 16. Gross adjustment of the height of the support structure is achieved by sliding the inner tube out of the outer tube so that the tubes almost fill the gap, within which supporting will be performed, and then a pin in the form of a small cylindrical rod is placed through the most appropriate holes 14 and slot 16 in the tubes. The pin sits on a collar 8 threaded onto the outer tube 2 and the collar may be raised and lowered by handle 12 to cause the inner tube to rise and fall to provide fine adjustment of the support structure. Different ranges of adjustment can be achieved by fitting the pin in different holes 14 in the inner tube 4. These features are known in the prior art and are present in the example shown in FIGS. 1A and 1B.

Figure 3:
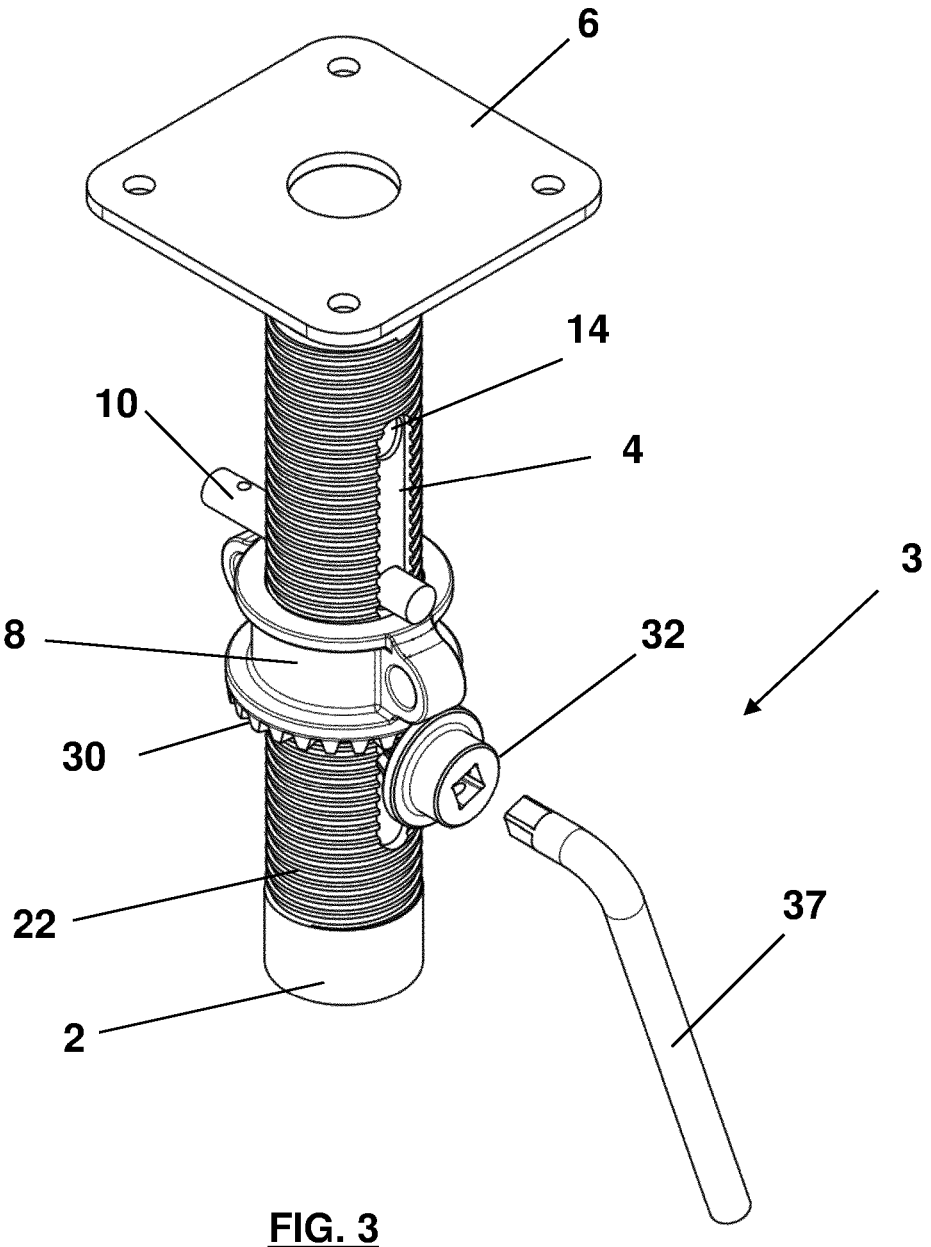
FIGS. 3 and 4 illustrate the shoring support structure shown in FIG. 2 with different types of actuators.
Figure 4:
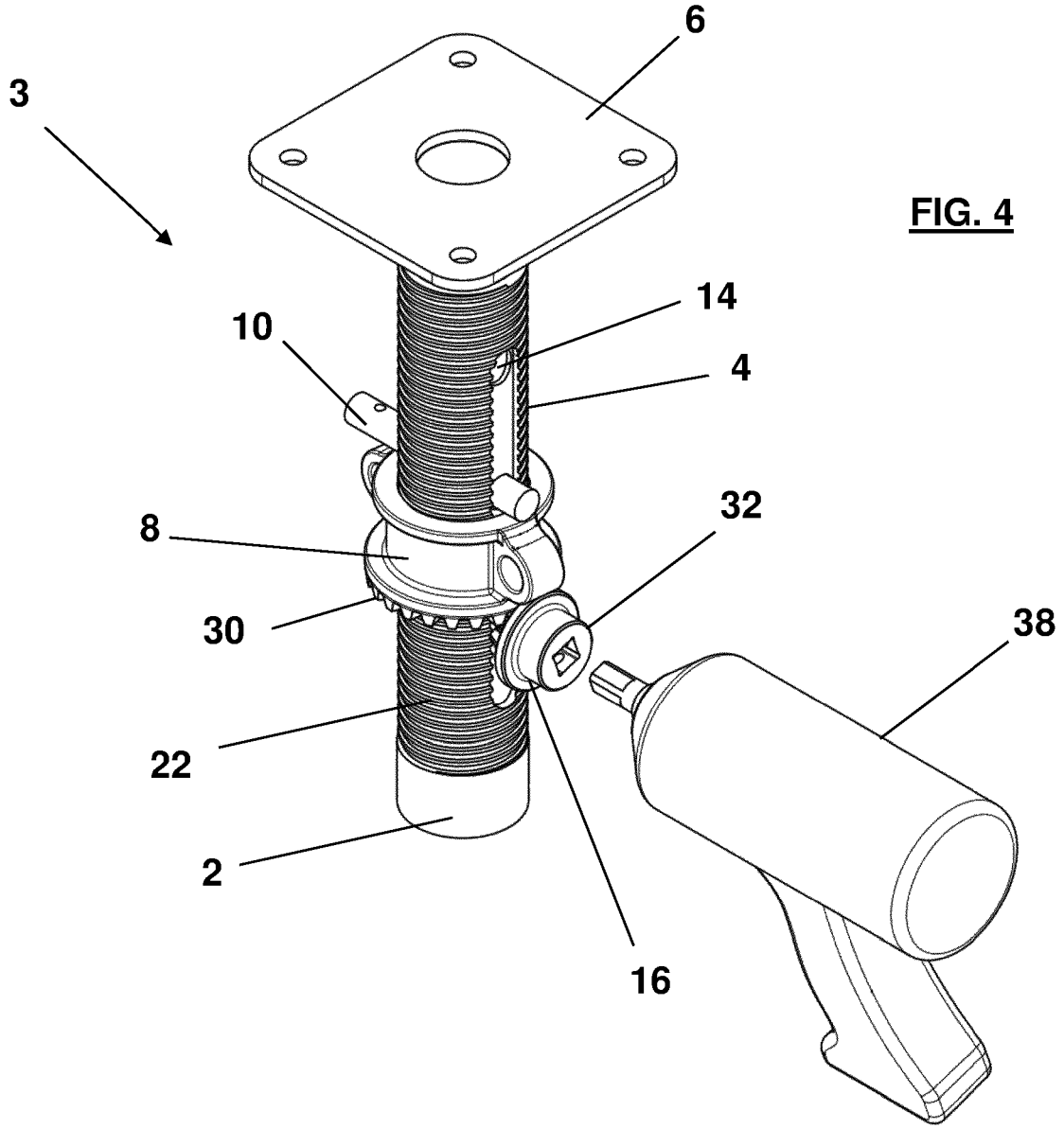
Figure 5A:
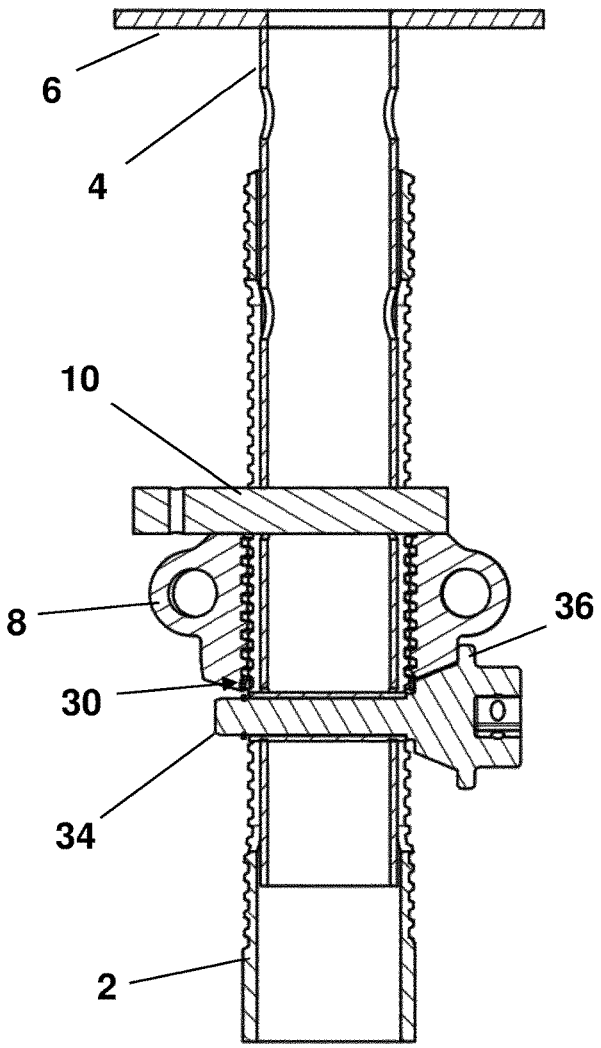
FIGS. 5A and 5B are respectively a cross-sectional view along line A-A and a side view of the shoring support structure shown in FIG. 2.
Figure 5B:
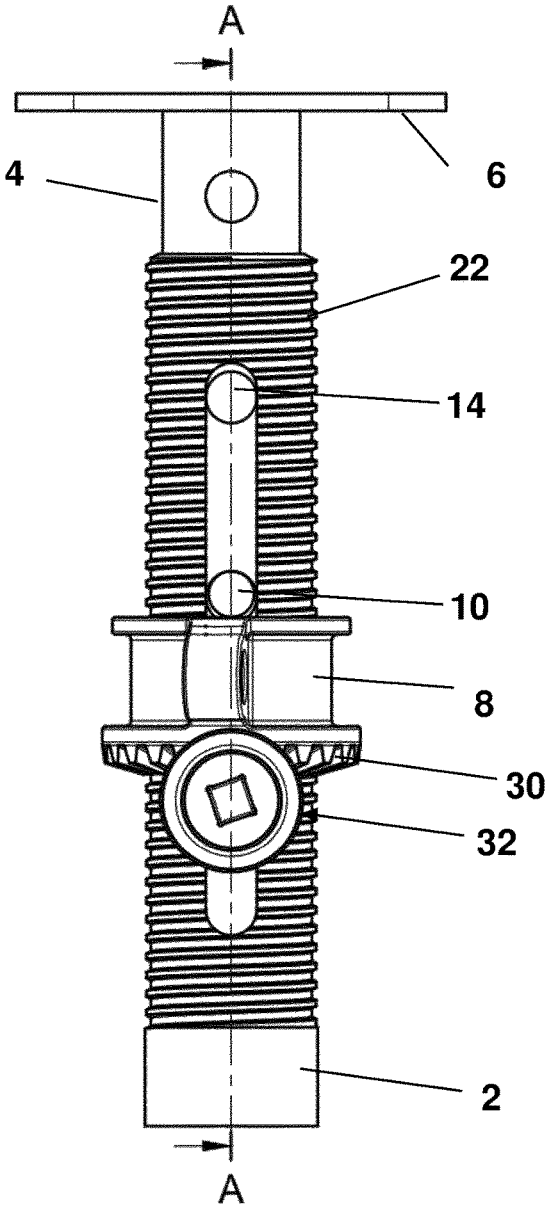
Figure 6:
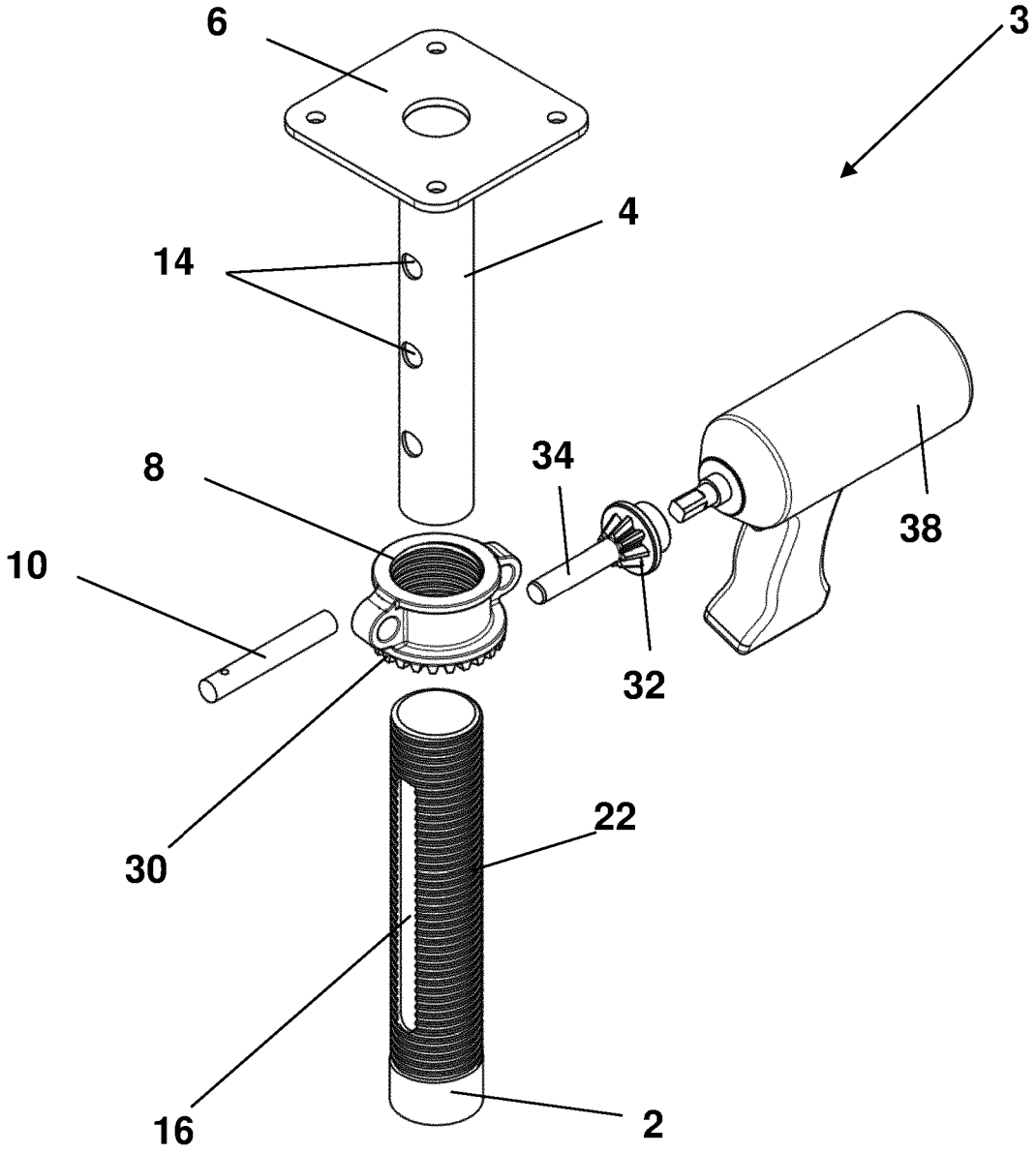
FIG. 6 is an exploded view showing the component parts of FIG. 4.

However, in the present embodiment, the collar 8 is adapted to include a driven member in the form of a bevel gear 30 on its lower surface and the inner tube 4 is provided with additional transverse holes 14 whereby a shaft 34 may be received through a pair of holes immediately below the collar with the pin provided through holes above the collar. The shaft 34 is connected to a driving member or pinion 32 having means for receiving an actuator 37, 38. A manual actuator may be used to turn the shaft and cause rotation of the collar via the pinion and bevel gear, such as a T-handle 37 or right-angled square drive, as shown in FIG. 3 but, more advantageously, a powered actuator 38 is used to operate the support structure, such as a drill or impact driver, as shown in FIGS. 4 and 6. The shaft is rotated in the holes of the inner tube and the proximity of these holes to the next pair up which receive the pin 10, keeps the driving member (pinion) and driven member (bevel gear) in contact to raise the collar and cause a corresponding movement of the inner tube. Thus, the support structure of the present invention may be installed in a conventional manner or its installation may be powered by an existing power tool, enabling one person to fix the structure in position quickly and easily.

The inclined face of the gears means that pushing the shaft axially inwards brings the bevel gear 30 and pinion gear 32 into closer contact. In the embodiment shown in FIGS. 2 to 7C (see in particular FIG. 5A), this axial movement is limited by a radial flange 36 provided on an outer end of the pinion 32 which acts on the periphery of the rotating collar 8.

It is to be appreciated that the shaft 34 and pinion 32 may be entirely removable from the support structure such that these parts may be provided as a tool for use on the installation of multiple support structures. Additionally, the gears may be sized such that they are only in partial contact and can be driven in further over time. This will increase the longevity of the structure because wear will occur in areas such as the holes, gears and pins. The act of pushing the driving member inwards will tend to keep the gears in contact but the structure could be adapted further to provide means to maintain the shaft in an appropriate axial position, such as by shaping the holes of the inner tube.

Figure 8:
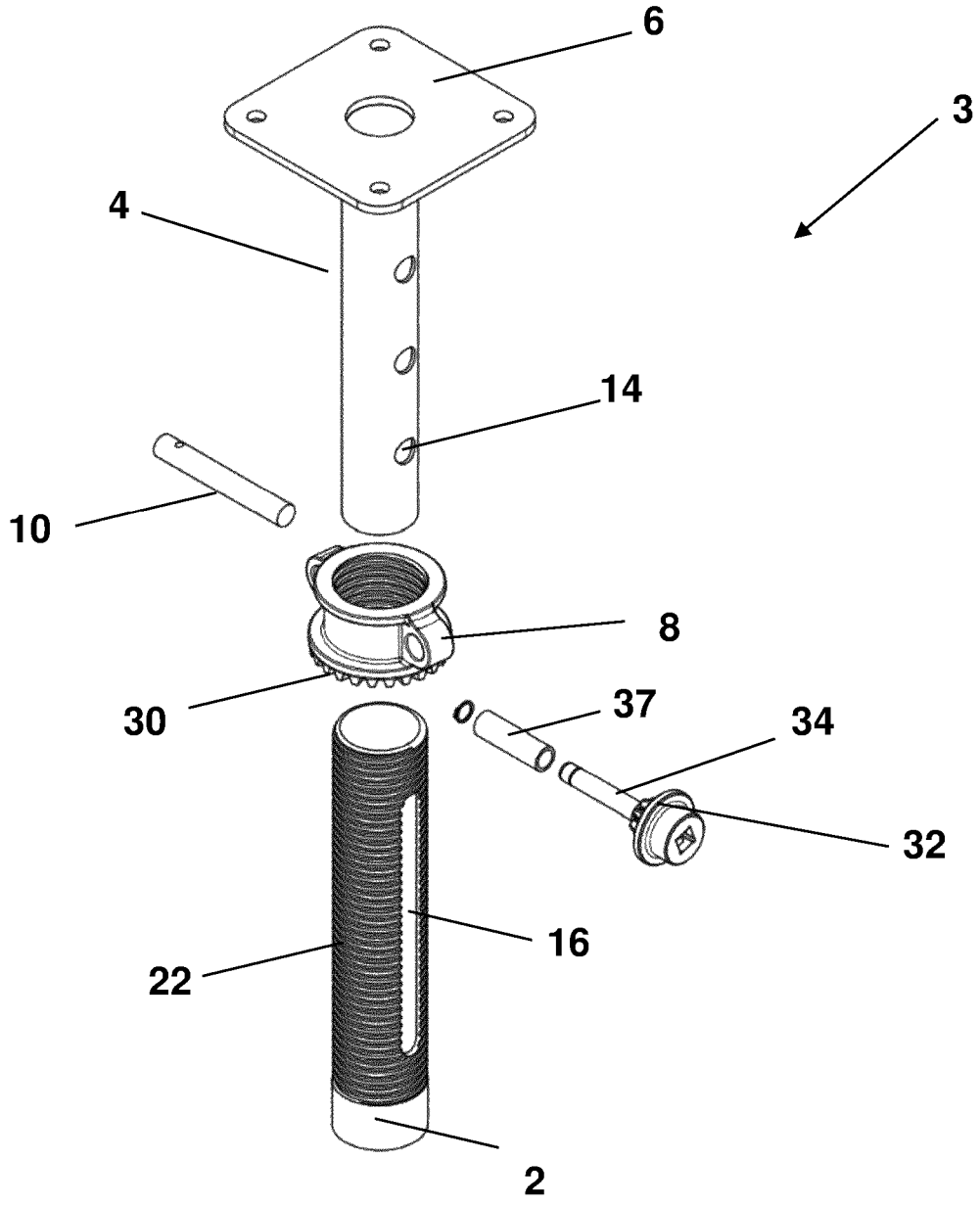
FIG. 8 is an exploded view of the component parts of a shoring support structure according to another embodiment of the present invention.

FIG. 8 illustrates an alternative embodiment of the present invention wherein a sleeve 37 is provided to surround the shaft 34 to reduce wear on the shaft and the inner tube holes 14. The sleeve is placed within the holes and does not rotate whilst allowing the shaft to rotate within the sleeve. This provides a much larger bearing area and avoids the shaft and inner tube holes becoming worn.

Figure 9:
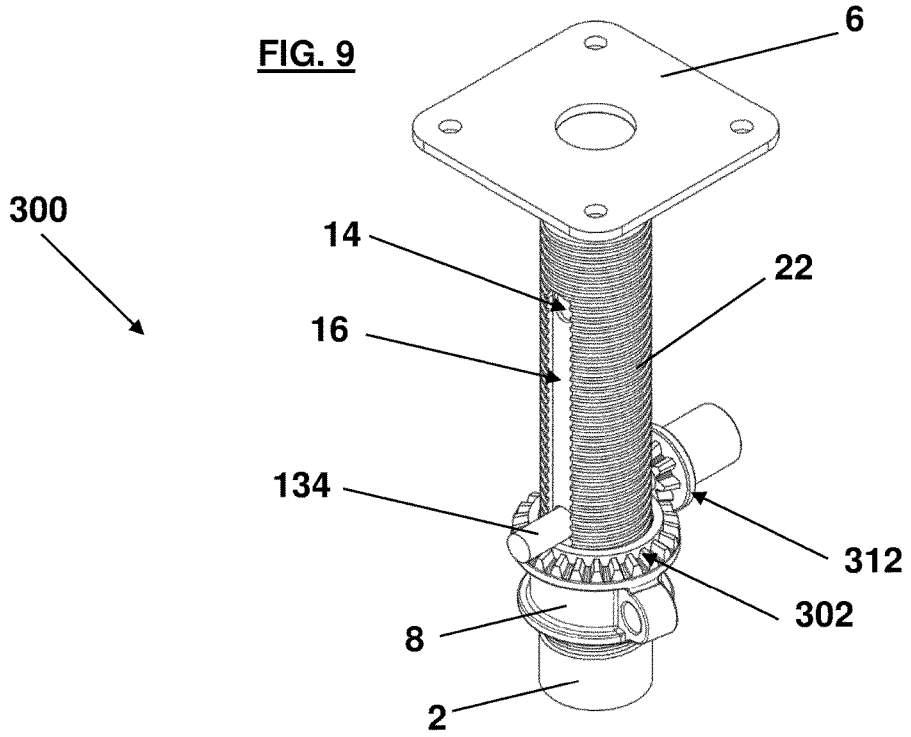
FIGS. 9 and 10 are respectively front and rear perspective views of a shoring support structure according to yet another embodiment of the present invention.
Figure 10:
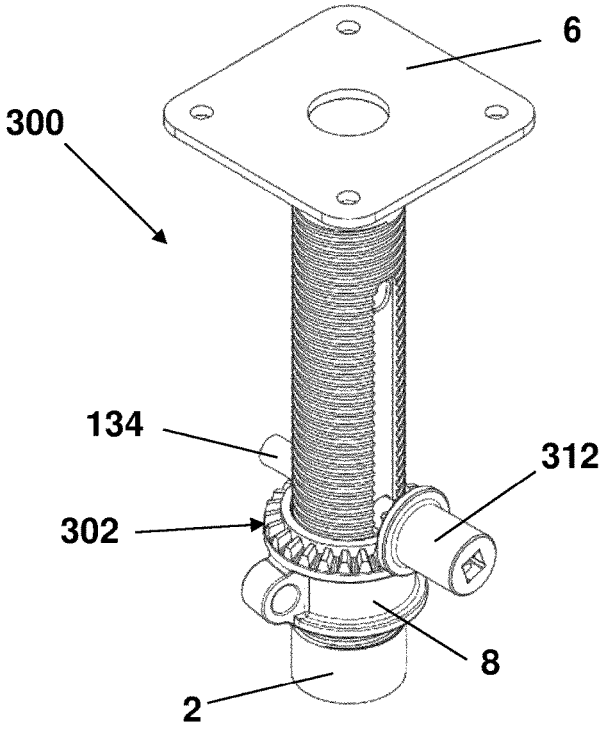
Figure 11:
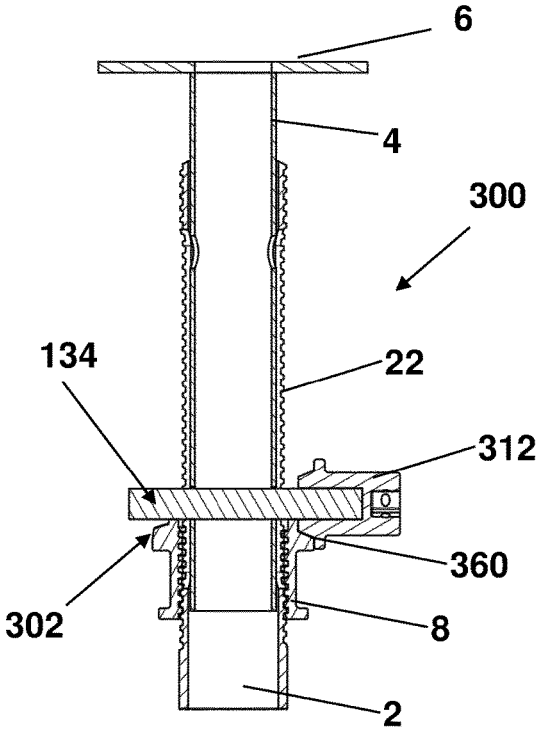
FIG. 11 is a cross-section view through the shoring support structure of FIGS. 9 and 10.
Figure 12:
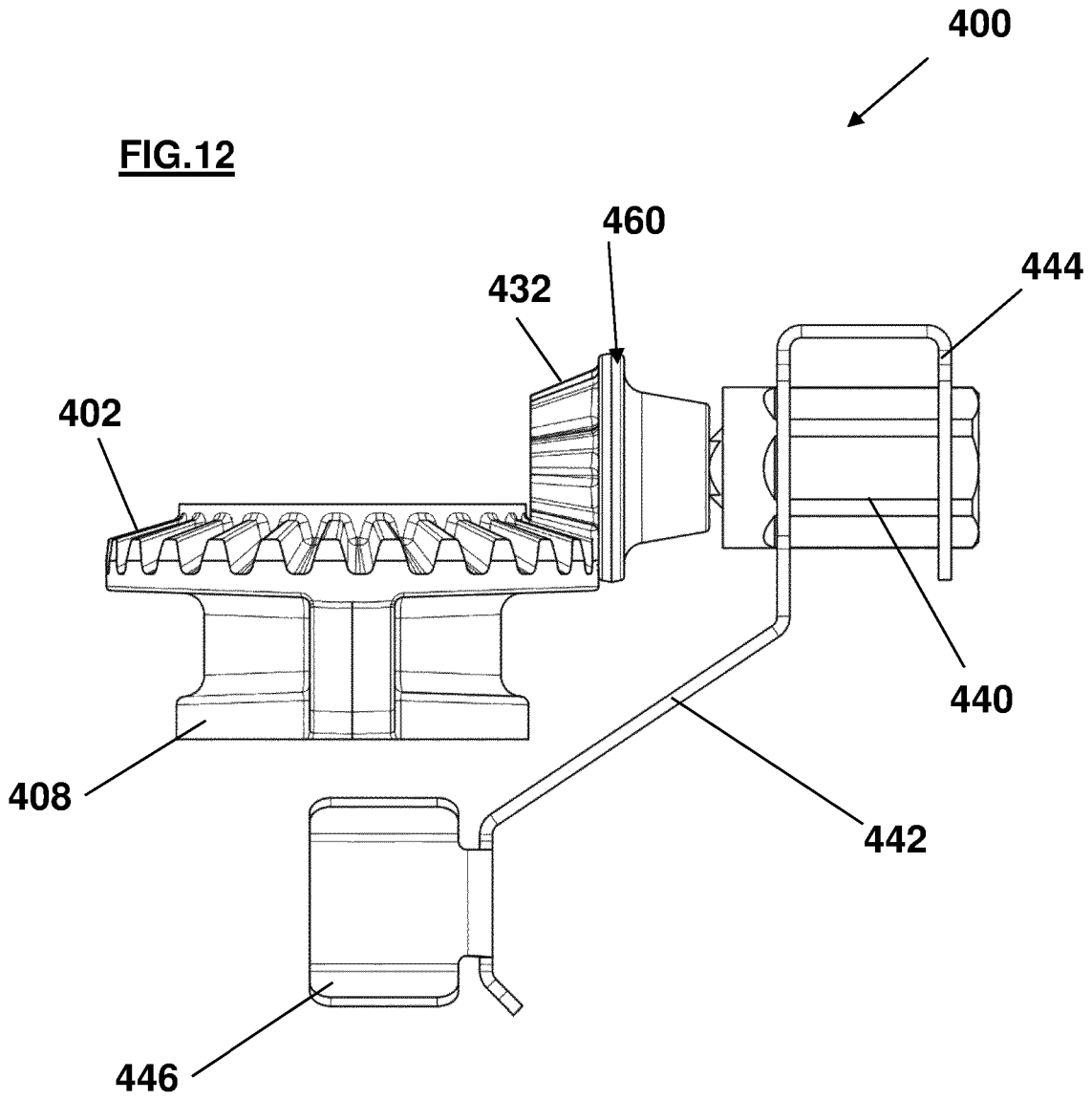
FIG. 12 is a side view of a kit of parts for a shoring support structure according to another embodiment of the present invention, shown without the shoring support.
Figure 13:
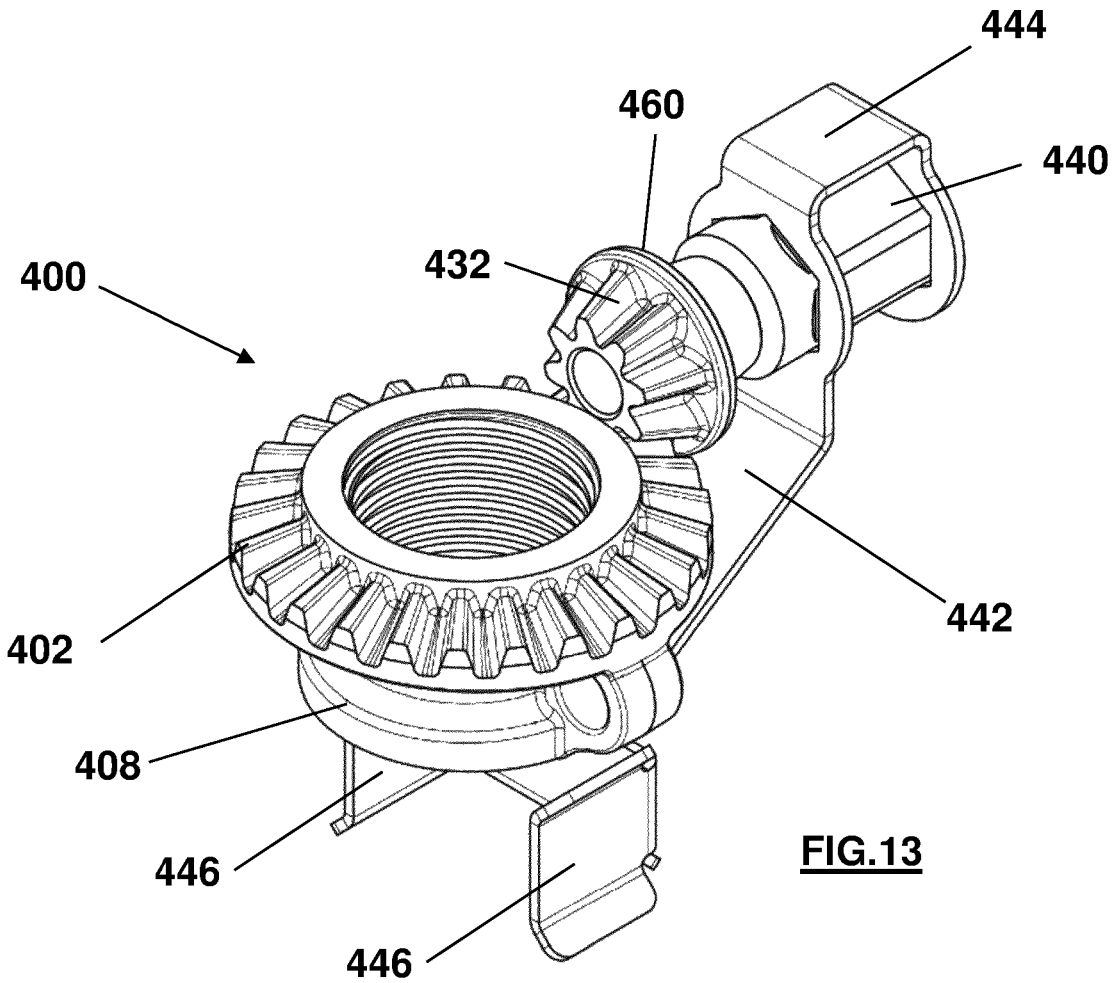
FIG. 13 is a top perspective view of the kit of parts shown in FIG. 12.

FIGS. 9 to 11 of the accompanying drawings illustrate another embodiment of a shoring support structure 300 according to the present invention. Identical features already discussed in relation to FIGS. 2 to 7C and 8 are given the same reference numerals and only the differences will be discussed in detail. In this embodiment, the collar is provided with a driven member in the form of a bevel gear 302 on the upper surface of the collar 8. The pin that is placed through the holes of the inner tube now serves as a shaft 134 for connection to, or support of, a driving member or pinion gear 312 having means for engagement with an actuator (not shown). The pinion gear 312 is again provided with a flange 360 to maintain close contact between the gears. Thus, this embodiment requires less modifications to an existing shoring support structure with the pin acting as the shaft and having the drive pinion wrap around it to engage with the bevel gear provided on the rotating collar 8. This has the added advantage that additional holes are not required to be provided in the inner tube, with travel within the existing slot dimensions retained. Again, the pin could be provided with an outer sleeve to reduce wear due to movement of the parts.

It is clear that the shoring support structure of the present invention may be provided as a completely new product or the component parts, in particular the collar with a bevel gear and pinion with shaft, may be provided separately to allow retrospective fitting to existing acrow props to enable these devices to be powered by an impact driver or drill.

While the illustrated embodiments are in relation to a vertical shoring support structure with flat base and head plates, it is to be appreciated that the support may be used in alternative orientations with different types of fixings, such as U-shaped head plates or L-shaped head plates. The plates may also be adjustable, for example, to enable them to be fixed at an angle depending upon the structure supported. As with conventional acrow props, the structures could be provided in a range of sizes to fit different sizes of gaps.

FIGS. 12 to 15 of the accompanying drawings illustrate an alternative kit of parts according to the present invention for fitting to a shoring structure. For the sake of simplicity, the inner and outer tubes and the pin that is placed through the holes of the inner tube to serve as a shaft are not shown in the figures but the parts are shown in their assembled state to illustrate their interconnection during operation. The kit again includes a rotating collar 408 provided with a driven member in the form of a bevel gear 402 on the upper surface of the collar 408 and a driving member or pinion gear 432 is provided to connect with the shaft/pin, the pinion gear 432 having a flange 460 to maintain close contact between the gears. Additionally, a torque multiplier 440 is connected to the pinion gear being supported by a bracket 444 and stabilised by a pair of substantially parallel plates 446 via a supporting arm 442. In this embodiment, the torque multiplier is a gearbox, such as a planetary gear, to increase the torque available from the input and may use a drive input, for example, a ¼ inch hex drive input found on an impact driver commonly used by builders. The plates 446 are fitted either side of the outer tube of the prop to wrap around the threaded outer tube and move up and down with the drive, reacting out the additional torque supplied by the multiplier to provide a stable assembly even when high torques are applied through the device. The stabilisation assembly may be made from any suitable material, such as a profiled and folded steel plate.

It is to be appreciated that the pinion gear 432 may also be provided with an input, such as a ½ inch square input that may be used directly with a high capacity input such as a large impact driver (having corresponding ½ inch square drive output), fitting over the pin as described previously. However, attachment of the torque multiplier 440 enables a higher torque to be reached using a lower output impact driver.

The device comprising the kit of parts shown in FIGS. 12 to 15 assists in preventing the driver spinning out of control and enables sufficiently high torques to be applied to heavy shoring support structures to allow easier adjustment of the positioning of the telescopically extendable tubes. The device also means that an input device, such as an impact driver, with a more modest output can be used to achieve the same torque at the pinion gear 432 as would have been developed by a larger input device directly attached to the pinion.

The invention claimed is:

1. An extendable structure comprising:

an outer tube having a threaded region with opposing longitudinal slots therethrough;

an inner tube slidable within the outer tube and having a plurality of pairs of transverse holes at spaced apart intervals;

a pin receivable through the slots of the outer tube and a pair of transverse holes of the inner tube;

a collar mounted on the threaded region and being rotatable to raise and lower the pin within the slots; and a driving member;

the collar including a driven member for mating with the driving member, the driving member being connectable to an actuator, actuation of the driving member causing rotation of the driven member to effect rotation of the collar, wherein the driven member is a bevel gear extending from an upper or lower surface of the collar and the driving member is a pinion gear that engages with the bevel gear provided on the collar, the extendable structure including a shaft for connection to the pinion gear, the shaft being provided by the pin serving as the shaft, wherein the pinion gear is configured to wrap around the pin to bevel ear provided on the collar.

2. An extendable structure as claimed in claim 1, wherein the bevel gear is provided on the upper surface of the collar.

3. An extendable structure as claimed in claim 1, wherein an outer surface of the pinion gear is provided with a recess or protrusion for mating with a corresponding protrusion or recess of the actuator.

4. An extendable structure as claimed in claim 1, wherein a powered actuator is provided to impart motion to the collar via the driving and driven members.

5. An extendable structure as claimed in claim 4, wherein the powered actuator is an impact driver or drill.

6. An extendable structure as claimed in claim 1, wherein the pinion gear includes an annular flange for acting on the collar to prevent axial movement of the gear.

7. An extendable structure as claimed in claim 1, wherein a non-rotatable sleeve surrounds the pin to reduce wear.

8. An extendable structure as claimed in claim 1, wherein the driving member is connected to a torque multiplier.

9. An extendable structure as claimed in claim 8, wherein the torque multiplier is provided with a stabilisation assembly.

10. An extendable structure as claimed in claim 9, wherein the stabilisation assembly comprises a bracket attached to the torque multiplier and a pair of parallel plates for placement against each side of the inner or outer tube, the plates being connected to the bracket by at least one supporting arm.

11. An extendable structure as claimed in claim 1, wherein the extendable structure is a shoring support structure having at least one of the inner and outer tube has a base plate at an end thereof.

12. An extendable structure as claimed in claim 1, wherein the pinion gear includes a flange for acting on the collar to prevent axial movement of the pinion gear.

13. An extendable structure comprising:

an outer tube having a threaded region with opposing longitudinal slots therethrough;

an inner tube slidable within the outer tube and having a plurality of pairs of transverse holes at spaced apart intervals;

a pin receivable through the slots of the outer tube and a pair of transverse holes of the inner tube; and a collar mounted on the threaded region and being rotatable to raise and lower the pin within the slots;

the collar including a driven member mating with a driving member, the driving member connectable to an actuator, actuation of the driving member causing rotation of the driven member to effect rotation of the collar, wherein the driven member is a bevel gear extending from an upper or lower surface of the collar and the driving member is a pinion gear that meshes with the bevel gear provided on the collar, wherein the pinion gear includes a flange for acting on the collar to prevent axial movement of the pinion gear.

14. An extendable structure comprising:

an outer tube having a threaded region with opposing longitudinal slots therethrough;

an inner tube slidable within the outer tube and having a plurality of pairs of transverse holes at spaced apart intervals;

a pin receivable through the slots of the outer tube and a pair of transverse holes of the inner tube; and a collar mounted on the threaded region and being rotatable to raise and lower the pin within the slots; and the collar including a driven member for mating with a driving member, the driving member connectable to an actuator, actuation of the driving member causing rotation of the driven member to effect rotation of the collar, wherein the driven member is a bevel gear extending from an upper or lower surface of the collar, wherein the driving member is connected to a torque multiplier and the torque multiplier is provided with a stabilisation assembly, wherein the stabilisation assembly comprises a bracket attached to the torque multiplier and a pair of parallel plates for placement against each side of the inner or outer tube, the plates being connected to the bracket by at least one supporting arm.

* * * * *